United States Patent [19]

Przybylinski et al.

[11] 4,228,742

[45] Oct. 21, 1980

[54] RAILWAY CAR INTEGRAL HOPPER STRUCTURE

[75] Inventors: Phillip G. Przybylinski, Schererville; Terry B. Morgan, Hammond, both of Ind.

[73] Assignee: Pullman Incorporated, Chicago, Ill.

[21] Appl. No.: 865,654

[22] Filed: Dec. 29, 1977

[51] Int. Cl.[2] ..... B61D 7/02; B61D 7/14; B61D 49/00

[52] U.S. Cl. ..... 105/248; 105/25 D; 105/253; 298/28

[58] Field of Search ..... 105/308 R, 308 A, 308 B, 105/308 C, 248, 249, 280, 25 D, 253, 282 R; 298/28; 406/118, 131, 138

[56] References Cited

U.S. PATENT DOCUMENTS

| | | | |
|---|---|---|---|
| 1,109,600 | 9/1914 | Rohlfing | 105/248 |
| 1,313,361 | 8/1919 | White | 105/248 |
| 2,051,984 | 8/1936 | Cartzdafner | 105/248 |
| 2,051,985 | 8/1936 | Cartzdafner | 105/248 |
| 2,206,938 | 7/1940 | Campbell | 105/308 R |
| 3,069,206 | 12/1962 | Borger | 406/138 |
| 3,138,409 | 6/1964 | Green et al. | 406/131 |
| 3,139,286 | 6/1964 | Johnson | 105/248 X |
| 3,149,310 | 12/1968 | Gramlich | 105/248 X |
| 3,339,499 | 9/1967 | Charles et al. | 105/248 |
| 3,557,713 | 1/1971 | Spence et al. | 105/248 X |
| 3,572,252 | 3/1971 | Coover et al. | 105/248 |
| 3,724,909 | 4/1973 | Adler | 406/118 |
| 3,742,865 | 7/1973 | Adler | 105/282 R |

*Primary Examiner*—John J. Love
*Assistant Examiner*—Howard Beltran
*Attorney, Agent, or Firm*—Stephen D. Geimer

[57] ABSTRACT

A vehicle hopper construction having longitudinally spaced hopper end slope sheets and hopper cross ridge slope sheets formed prior to assembly in the vehicle hopper so as to provide integral interior hopper corner plates with associated transversely spaced hopper side sheets.

5 Claims, 4 Drawing Figures

RAILWAY CAR INTEGRAL HOPPER STRUCTURE

BACKGROUND OF THE INVENTION

1. Field of the Invention

The field of art to which this invention pertains is hopper vehicles and in particular to a method of construction of hoppers which includes longitudinally spaced hopper slope sheets, transversely spaced hopper side sheets, and corner plates fixedly mounted in the vicinity of the junctions of said slope sheets and side sheets.

2. Prior Art

The use of corner plates in hopper vehicle construction has long been known in the art, and has provided designers with flexibility in arriving at hopper designs which permit optimum efficiency in the discharge of the lading. Interior angles of corners and slope surfaces become critical in hopper design where lading may be particulate comminuted or pellet-like in nature, having the characteristic of relatively low density, and therefore is more susceptible to the forces which tend to retain lading within the hopper structure during discharge operations. The use of internal corner plates has permitted designers to compensate for these flow characteristics by increasing slope angles in hopper corners and by eliminating small interior angles.

Until now, internal corner plates have been pre-cut and rigidly mounted within the hoppers, usually by welding or riveting, after assembly of associated slope sheets and side sheets.

SUMMARY OF THE INVENTION

The present invention facilitates fabrication and assembly of hoppers and hopper vehicles by pre-shaping of cross-ridge and end slope sheets, or any other two oppositely disposed sides of a hopper, to include an integrally formed corner plates. Assembly with associated hopper sheets, or the remaining oppositely disposed sides of a hopper results in a hopper unit with integral corner plates, the hopper chute having properly articulated slope and internal angles, precluding the necessity of additional fabrication and assembly of non-integral corner plates.

DESCRIPTION OF PREFERRED EMBODIMENT

Figure 1:
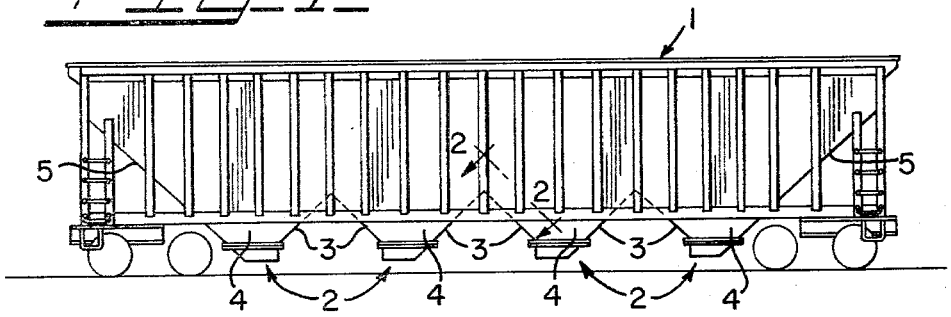
FIG. 1 is a side elevational view of a typical railway hopper car.

Referring to FIG. 1, a typical, railway hopper car 1 is shown, including a plurality of longitudinally spaced hoppers 2. Each hopper includes cross-ridge slope sheets 3 and associated hopper side sheets 4. The hoppers 2 which are longitudinally spaced at the end-most portions of the car 1 also each include an end slope sheet 5. Each hopper includes a discharge control arrangement, not shown, as well known to the art. A typical arrangement is disclosed by U.S. Pat. No. 3,742,865, Adler.

Figure 2:
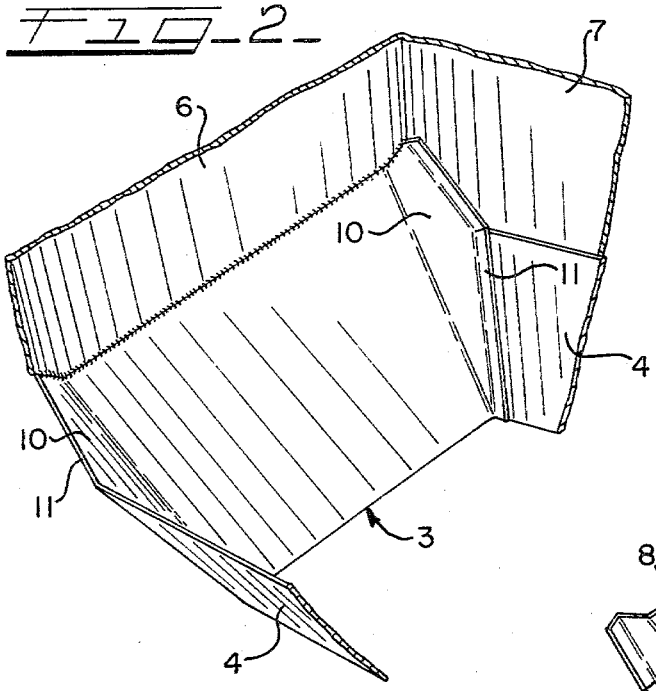
FIG. 2 is a perspective cut away view of the inside of the hopper taken substantially along the line 2—2 of FIG. 1.
Figure 4:
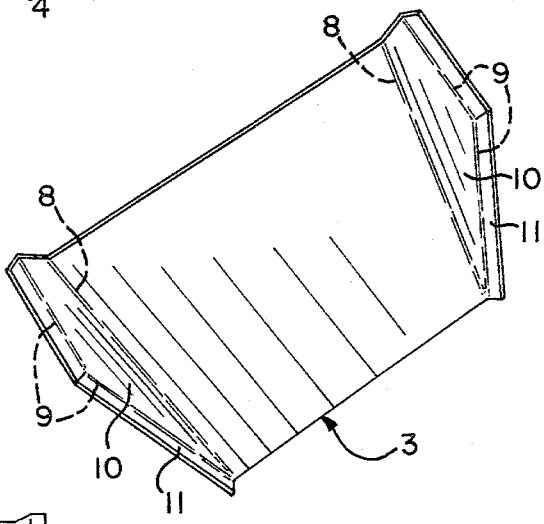
FIG. 4 is a perspective view of a typical, preformed cross-ridge slope sheet prior to assembly.
Figure 3:
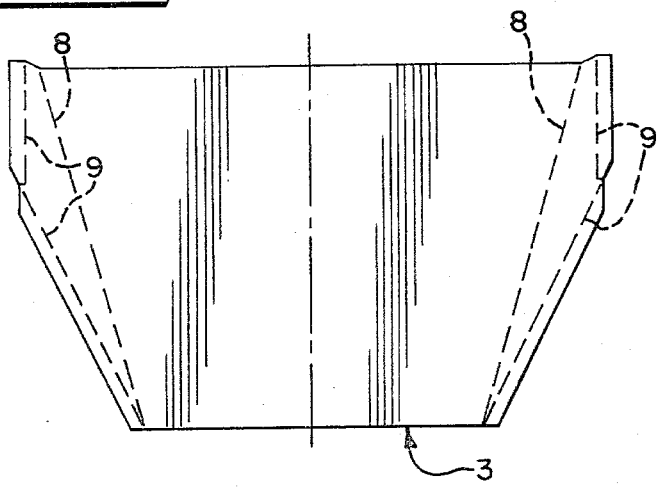
FIG. 3 is a plan view of a cross-ridge slope sheet of the present invention prior to preforming and assembly.

FIG. 2 shows a perspective cut away view of the interior of one of the hoppers 2 and illustrates the resultant structure of the present invention. A preformed cross-ridge slope sheet 3 is shown rigidly assembled with associated internal vertical partition wall or sheet 6, car side wall 7, and associated hopper side sheets 4 to form a hopper chute. The slope sheet 3 has been fashioned from sheet stock and is shown in FIG. 3, prior to bending along bend lines 8 and 9. The size and shape of slope sheet 3, as well as the disposition and bending angle of bend lines 8 and 9 can be varied by the car designer in order to achieve the slope and internal angles of the hopper for optimum flow characteristics. FIG. 4 illustrates slope sheet 3 after bending along bend lines 8 and 9. The resultant component slope sheet 3 includes intermediate portion 10', integral corner plate portions 10,10 and assembly flange 11,11 as shown in FIG. 4 and FIG. 2. Slope sheet 3, as illustrated in FIG. 4, is ready for assembly with associated components as illustrated in FIG. 2. Slope sheet 3 is rigidly assembled by either welding or riveting about its periphery and results in a hopper construction which includes integral corner plates 10.

From the foregoing, it is readily apparent that the integral corner plate arrangement of the hopper construction embodied in the present invention enhances the structural integrity as well as ease of fabrication and assembly of the car. More particularly, by integrally forming or stamping the corner plates 10 in the slope sheets, the invention abates or reduces fatigue fracture or separation of the conventional assembly joints associated with the valley plate designs disclosed by the prior art.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. For a hopper vehicle having a generally vertically disposed hopper including a hopper chute, a hopper chute construction including longitudinally spaced, downwardly and inwardly extending hopper chute slope sheets, vertical partition sheets connected to said spaced hopper chute slope sheets, transversely spaced, downwardly and inwardly extending hopper chute side sheets connected to said slope sheets, and transversely spaced side walls connected to and extending upwardly from said side sheets and connected to opposite sides of said slope sheets and said partition sheets, the improvement comprising:

each of said slope sheets including transversely spaced corner plate portions and an intermediate portion connected with said corner plate portions, said corner plate portions extending angularly upwardly and outwardly relative to said intermediate portion and being integrally formed therewith and thereby providing said slope sheets with a continuous channel surface, and means connecting said corner plate portions to said side sheets, said corner plate portions forming generally planar surfaces extending between said intermediate portion and said side sheets to promote the flow of lading through the hopper chute.

2. The invention in accordance with claim 1,
said means connecting having outwardly extending flange portions welded to said hopper side sheets.

3. The invention in accordance with claim 1,
each of said hopper chute slope sheets and said associated corner plate portions being formed from a single sheet of material.

4. The invention in accordance with claim 2,
said means connecting having outwardly extending further flange portions welded to said hopper side walls.

5. The invention in accordance with claim 1,
said corner plate portions each having an upper edge portion rigidly affixed to one of said vertical partition sheets.

* * * * *